US008425082B2

(12) United States Patent
Wang

(10) Patent No.: US 8,425,082 B2
(45) Date of Patent: Apr. 23, 2013

(54) MAGNETIC DETACHABLE MULTI-FUNCTIONAL LED LAMP

(75) Inventor: Robert Wang, Taoyuan County (TW)

(73) Assignee: Ceramate Technical Co., Ltd., Taoyuan County (TW)

( * ) Notice: Subject to any disclaimer, the term of this patent is extended or adjusted under 35 U.S.C. 154(b) by 156 days.

(21) Appl. No.: 13/081,313

(22) Filed: Apr. 6, 2011

(65) Prior Publication Data

US 2012/0194069 A1 Aug. 2, 2012

(30) Foreign Application Priority Data

Jan. 31, 2011 (TW) ..... 100202307 U

(51) Int. Cl.
*F21V 33/00* (2006.01)

(52) U.S. Cl.
USPC ..... 362/249.02; 362/398

(58) Field of Classification Search ..... 362/249.02, 362/398
See application file for complete search history.

(56) References Cited

U.S. PATENT DOCUMENTS

2008/0247160 A1* 10/2008 Jiang ..... 362/227
2008/0298056 A1* 12/2008 Petersen ..... 362/235
2009/0135331 A1* 5/2009 Kawase ..... 349/58
2010/0271834 A1* 10/2010 Muessli ..... 362/398

* cited by examiner

*Primary Examiner* — Laura Tso
(74) *Attorney, Agent, or Firm* — Ming Chow; Sinorica, LLC

(57) ABSTRACT

A magnetic detachable multi-functional LED lamp includes a power source lamp seat and a luminous lamp unit. The power source lamp seat is provided with a plurality of magnetic units, while the luminous lamp unit is fixed with plural magnetic sucking members respectively corresponding with the magnetic units of the power source lamp seat. By so designing, the luminous lamp unit of the LED lamp can be attracted and fixed on the power source lamp seat by magnetic function of the magnetic units provided on the power source lamp seat, facilitating components of the LED lamp to be assembled, dissembled and replaced, attaining effects of energy saving and carbon reduction, lessening electronic waste and promoting green environmental protection.

9 Claims, 9 Drawing Sheets

MAGNETIC DETACHABLE MULTI-FUNCTIONAL LED LAMP

BACKGROUND OF THE INVENTION

1. Field of the Invention

This invention relates to a magnetic detachable multi-functional LED lamp.

2. Description of the Prior Art

Generally, a fluorescent lamp consumes much power and contains mercury and fluorescent powder that are harmful to human bodies; therefore, lamps using LED as luminous sources have taken the place of fluorescent lamps in recent years. However, the power source portion of a conventional LED is necessary to provide an AC/DC inverter and a driving circuit, while its luminous source portion has to be equipped with a constant-current circuit and an LED module, hence increasing cost considerably. In addition, although only the LED module of the luminous source portion is likely to cause trouble, yet, so long as one LED is damaged, lighting becomes uneven and it needs to be replaced. Therefore, the whole set of LED lamp is to be thrown away and replaced with a new one, thus wasting money, (because the power source portion or the lamp are still usable), and also encumbering environment. Moreover, although it is unlikely to squander money and impair environmental protection in case only the LED module is replaced, with other good parts kept in use, yet an LED contains lots of components and in an assembling process, many locking members like screws are often used. Therefore, it is extremely inconvenient in replacing and maintaining and as a result, users may hesitate to use LED lamps.

SUMMARY OF THE INVENTION

The objective of this invention is to offer a magnetic detachable multi-functional LED lamp, which includes a power source lamp seat and a luminous lamp unit. The power source lamp seat is provided with a plurality of magnetic units while the luminous lamp unit is fixed thereon with plural magnetic sucking members respectively corresponding with the magnetic units of the power source lamp seat. Designed in this way, the luminous lamp unit of the LED lamp can be fixedly assembled on the power source lamp seat by magnetic function of the magnetic units provided on the power source lamp seat, convenient in assembling, disassembling and replacing the components of the LED lamp.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
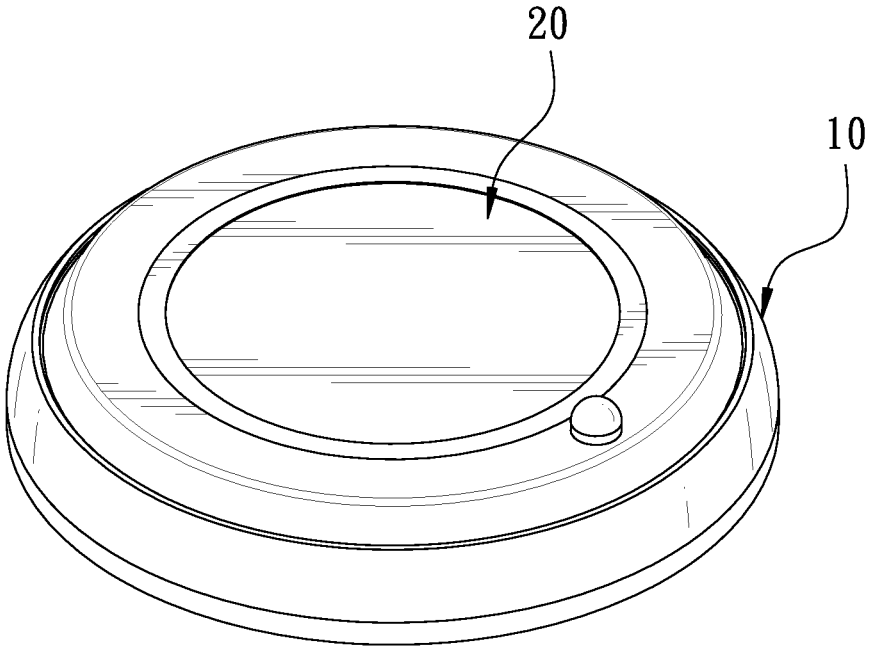
FIG. 1 is a perspective view of a first preferred embodiment of a magnetic detachable multi-functional LED lamp in the present invention.
Figure 2:
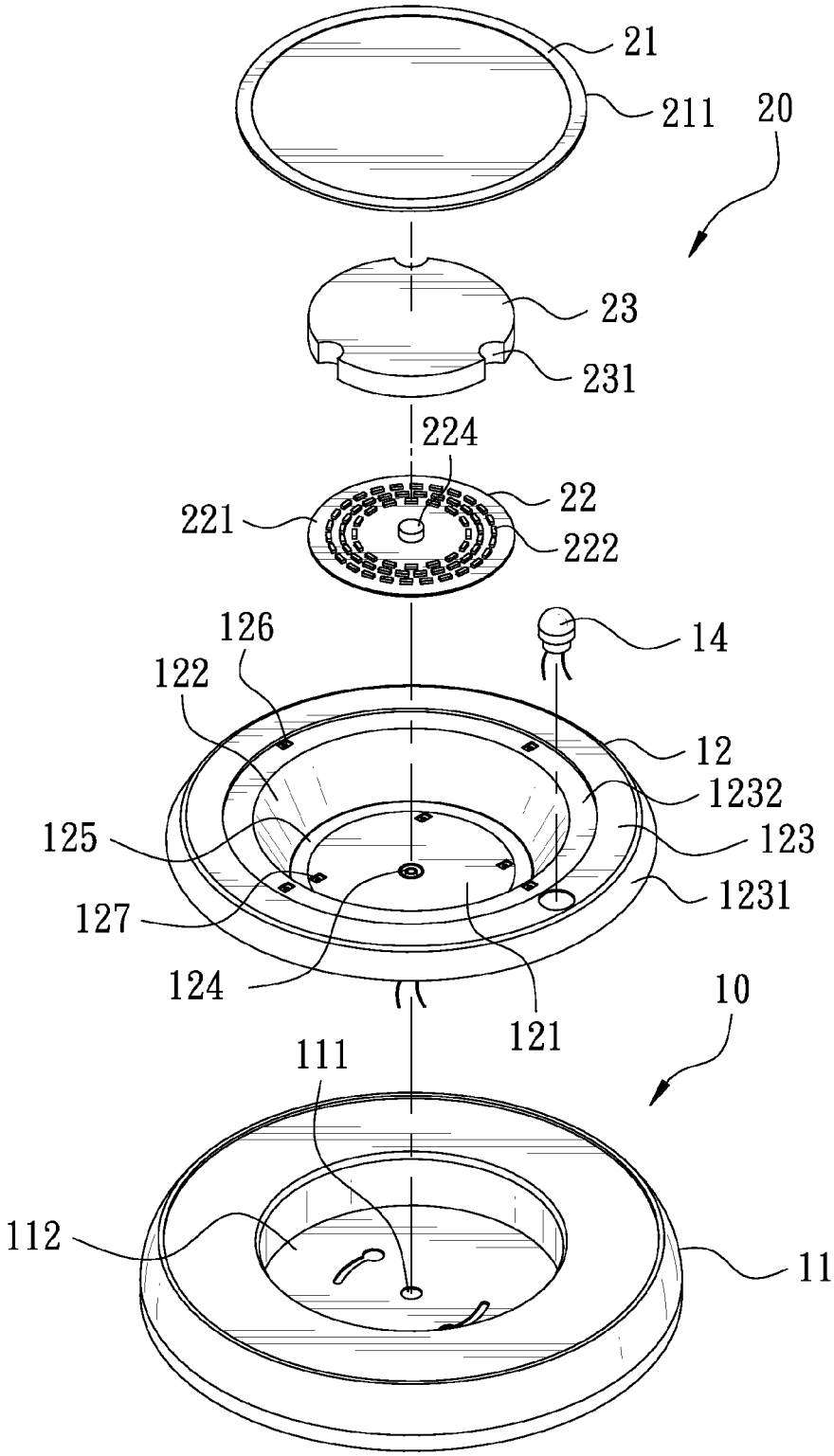
FIG. 2 is an exploded perspective view of the first preferred embodiment of the magnetic detachable multi-functional LED lamp in the present invention.
Figure 3:
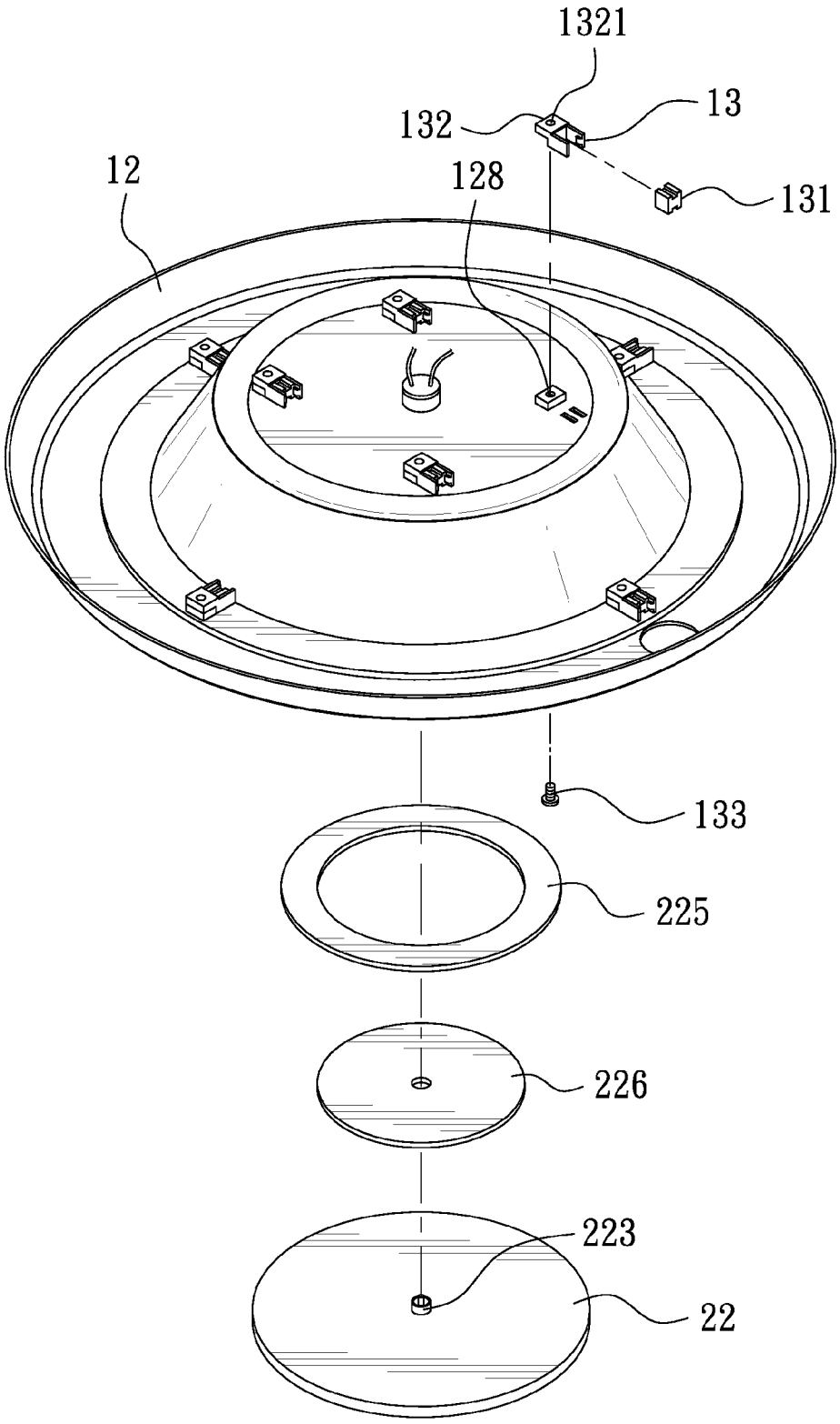
FIG. 3 is a partial exploded perspective view of the first preferred embodiment of the magnetic detachable multi-functional LED lamp in the present invention.

A first preferred embodiment of a magnetic detachable multi-functional LED lamp in the present invention, as shown in FIGS. 1, 2 and 3, includes a power source lamp seat 10 and a luminous lamp unit 20 as main components combined together.

The power source lamp seat 10 consists of a lamp disc 11, a lamp holder 12 and a plurality of magnetic units 13.

The lamp disc 11 is made integrally of iron, having a bottom bored with a plurality of through holes 111 for facilitating the lamp disc 11 to be locked on a ceiling or on a top wall, and formed with an accommodating groove 112 for receiving the lamp holder 12 therein.

The lamp holder 12 is shaped as a disc made of aluminum that is easy to dissipate heat and formed with a bottom plate 121 having a circumferential edge extending upward to form a circumferential wall 122 that has its top end stretched outward and transversely to form an annular flange 123 extended downward and formed with a heat-dissipation portion 1231. Further, the annular flange 123 of the lamp holder 12 is bored with an annular recess 1232 facing the bottom plate 121, and the bottom plate 121 of the lamp holder 12 is formed with a central connecting portion 124, which is a co-axial annular metal seat having an interior provided with contacts to form a non-polar adapter and can be connected with a conductive wire (not shown) for electrically connecting utility power. Furthermore, the bottom plate 121 of the lamp holder 12 has its circumferential edge disposed with an annular recessed edge 125, and the lamp holder 12 is formed with a plurality of first receiving members 126 and second receiving members 127. In this preferred embodiment, the first and the second receiving members 126 and 127 are respectively located in chambers defined by the annular recess 1232 and the bottom plate 121, and the bottom of the lamp holder 12 is bored with a first threaded hole 128.

The magnetic units 13 are set on the first receiving members 126 and the second receiving members 127, respectively consisting of a powerful magnet 131, a protective casing 132 and a bolt 133. The protective casing 132 is bored with a second threaded hole 1321 corresponding with the first threaded hole 128. The powerful magnet 131 is firmly fixed in the protective casing 132, and the bolt 133 is inserted in the first and the second receiving members 126 and 127 of the lamp holder 12 to have the protective casing 132 firmly locked at another side of the lamp holder 12.

The luminous lamp unit 20 to be installed on the power source lamp seat 10 is composed of a lampshade 21, an LED luminous module 22 and a lamp cover 23.

The lampshade 21 corresponding with the lamp holder 12 is generally a circular plane plate made of transparent acrylic.

The lampshade 21 has its surface provided with a pattern layer (not shown) for performing projection, installed with a first magnetic sucking member 211 corresponding with the first receiving member 126 of the lamp holder 12. In this preferred embodiment, the first magnetic sucking member 211 is an iron ring fastened around the circumferential edge of the lampshade 21.

The LED luminous module 22 shaped as a disc is provided with a base plate 221 formed with a topside and a bottom side. The topside of the base plate 221 is provided thereon with a plurality of LEDs 222, while the bottom side is provided with a combining member 223 corresponding with the connecting portion 124 of the bottom plate 121 and able to be combined with the connecting portion 124 to form electrical connection. In this preferred embodiment, the combining member 223 is a co-axial annular metal terminal to be electrically connected with the connecting portion 124. Further, the LED luminous module 22 is disposed with a built-in power control circuit unit 224, and the underside of the base plate 221 is secured with a second magnetic sucking member 225 corresponding with the second receiving member 127 of the lamp holder 12 and also stuck with a heat-dissipating gluey pad 226. In this preferred embodiment, the second magnetic sucking member 225 is an iron ring.

The lamp cover 23 is made integrally of transparent material to be engaged on the topside of the LED luminous module 22, having its outer edge formed with a plurality of notches 231 for facilitating a user to assemble or disassemble the LED luminous module 22 together with the lamp cover 23.

Figure 4:
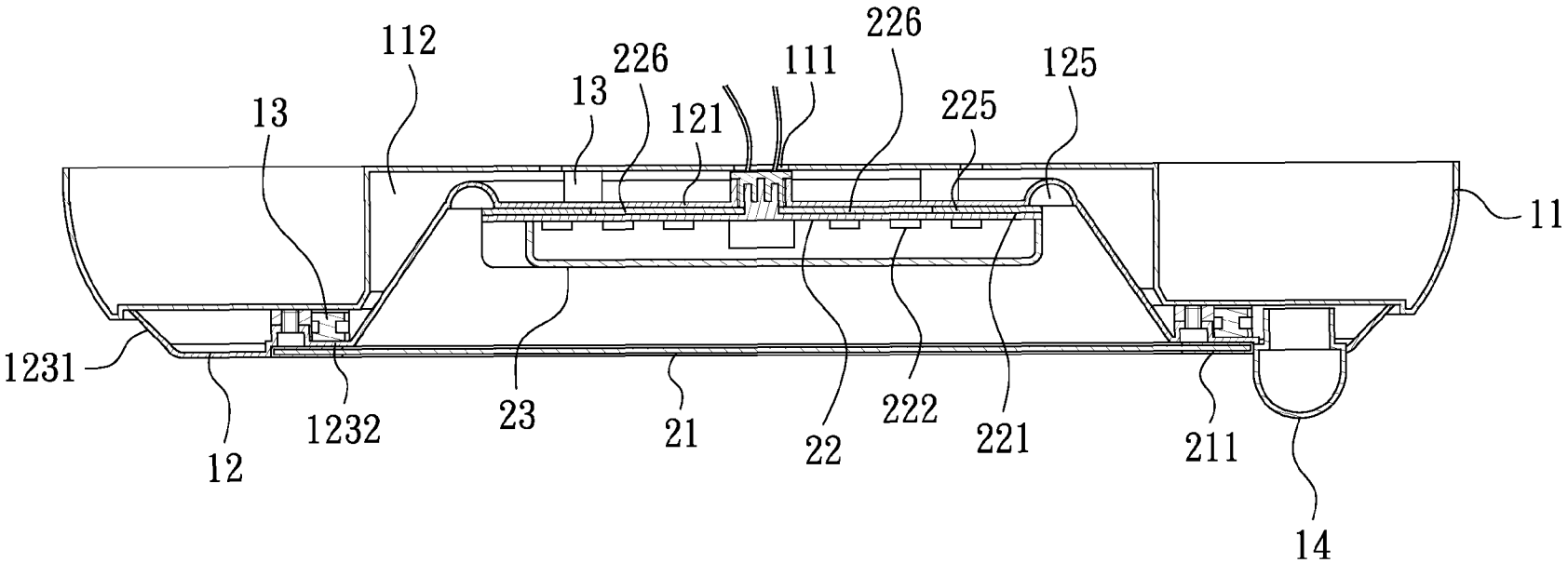
FIG. 4 is a cross-sectional view of the first preferred embodiment of the magnetic detachable multi-functional LED lamp in the present invention.
Figure 5:
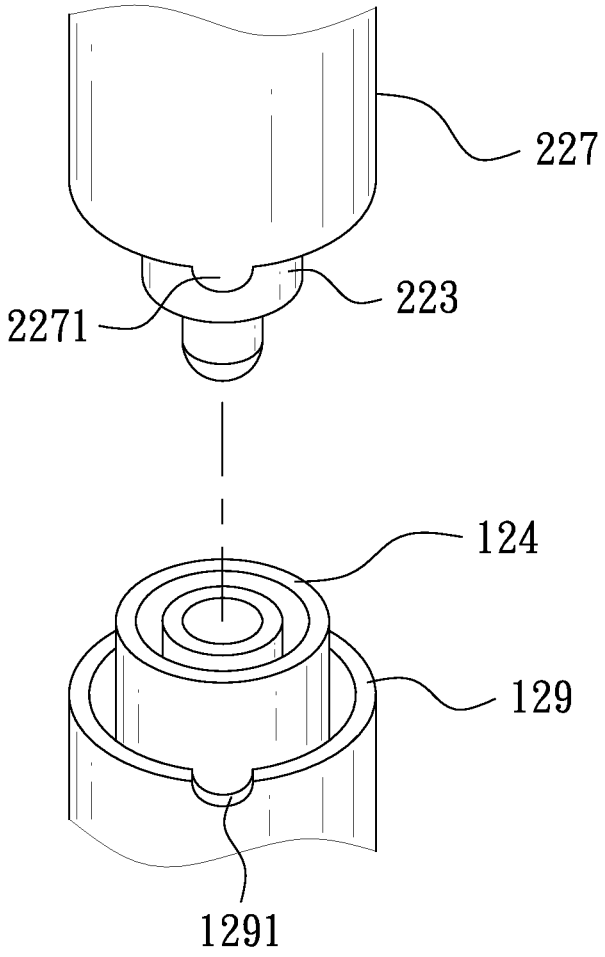
FIG. 5 is a partial perspective view of the first preferred embodiment of the members of an LED lamp, which are to be combined together, in the present invention.

Referring to FIG. 4, to assemble an LED lamp, which is a ceiling mount lamp, firstly, the lamp disc 11 is fixedly installed on a ceiling of a room and then, the components of the LED lamp are assembled in sequence. The magnetic units 13 are first assembled on the bottom plate 121 and the annular recess 1232 of the lamp holder 12 to have the lamp holder 12 attracted and fixed in the accommodating groove 112 of the lamp disc 11 by magnetic function of the magnetic units 13. Next, the combining member 223 at the underside of the base plate 221 is combined together with the connecting portion 124 of the bottom plate 121, as shown in FIG. 5. The combining member 223 and the connecting portion 124 have their circumference respectively fixedly surrounded by a first positioning tube 227 and a second positioning tube 129, and the first positioning tube 227 and the second positioning tube 129 are respectively formed thereon with a positioning projection 2271 and a position notch 1291 engaging with the positioning projection 2271; therefore, when the combining member 223 and the connecting portion 124 are to be combined together, the positioning projection 2271 can be rotatably engaged with the position notch 1291, letting the combining member 223 and the connecting portion 124 mutually restricted immovably in position. The base plate 221 of the LED luminous module 22 is installed with the second magnetic sucking members 225 respectively corresponding with the magnetic units 13 of the bottom plate 121 so that the LED luminous module 22 can be attracted and positioned on the bottom plate 121 of the lamp holder 12 by magnetic function of the magnetic units 13. Subsequently, the lampshade 21 is assembled on the annular recess 1232 of the lamp holder 12 and, by means of the first magnetic sucking member 211 fixed on the circumferential edge of the lampshade 21 and corresponding with the annular recess 1232, the lampshade 21 can be attracted and positioned on the lamp holder 12, thus finishing installation. By so designing, the components of the LED lamp can be mutually combined together via magnetic function of the magnetic units 13, convenient in installation and detachment, and the aluminum-made lamp holder 12 and the heat-dissipating gluey pad 226 enable the LED luminous module 22 to carry out heat dissipation.

Therefore, when the LED luminous module 22 has trouble and has to be replaced, it is easy to detach the lampshade 21, and the annular recessed edge 125 at the circumferential edge of the bottom plate 121 of the lamp holder 12 offers a working space for facilitating a user to turn the LED luminous module 22 with fingers and disassemble it from the lamp holder 12. And, after the LED luminous module 22 is electrically disconnected from the utility power, the LED luminous module 22 can be replaced with a new one, convenient in disassembling and repairing the LED lamp.

In addition, the base plate 221 of the LED luminous module 22 can be closely stuck to the bottom plate 121 of the lamp holder 12 by means of the heat-dissipating gluey pad 226, and the heat energy produced by the LEDs 222 can be transmitted to the aluminum bottom plate 121 through the heat-dissipating gluey pad 226 and then transmitted to the heat-dissipating portion 1231 of the lamp holder 12 to be exhausted to external surroundings, having excellent effect of heat dissipation. Further, a cooling fin (not shown) can be provided at the rear side of the bottom plate 121 of the lamp holder 12 for reinforcing the effect of heat-dissipation.

What is worth mentioning is that the lampshade 21 of this invention is provided thereon with a pattern layer able to cast patterns or words and phrases on the ground when the pattern layer is irradiated by light, letting the LED lamp produce various visual effects. For instance, indications for the stories structure of a building and the escaping direction in case of electric stoppage can be cast on the ground to let the pedestrians know. Additionally, the lampshade 21 made of acrylic can be shaped into an arcuate shade for increasing an area of lighting and enhancing the brightness of the LED lamp.

Moreover, the lamp holder 12 of this invention can be provided with a detector 14, which can be a human body detector, a fire detector, an earthquake detector or other warning detectors, for elevating additional value of this invention.

Figure 6:
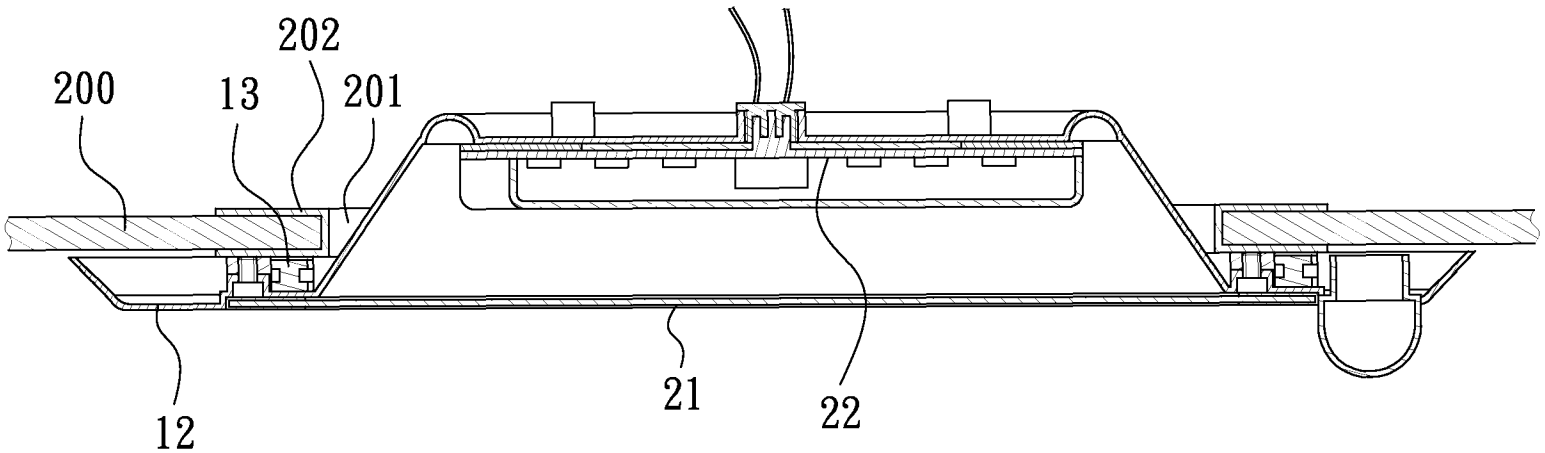
FIG. 6 is a cross-sectional view of a second preferred embodiment of a magnetic detachable multi-functional LED lamp in the present invention.

A second preferred embodiment of magnetic detachable multi-functional LED lamp in the present invention, as shown in FIG. 6, is a down-light fixedly installed on a top plate of a general room. Firstly, the open slot 201 of the top plate 200 has its circumferential edge assembled with a U-shaped iron plate 202 and then, the lamp holder 12 is directly attracted and fastened on the top plate 200 by magnetic function produced by the magnetic units 13 on the lamp holder 12 and the U-shaped iron plate 202. Afterward, the LED luminous module 22 and the lampshade 21 are orderly installed on the lamp holder 12 by means of the magnetic units 13, thus completing assembly of the LED lamp.

Figure 7:
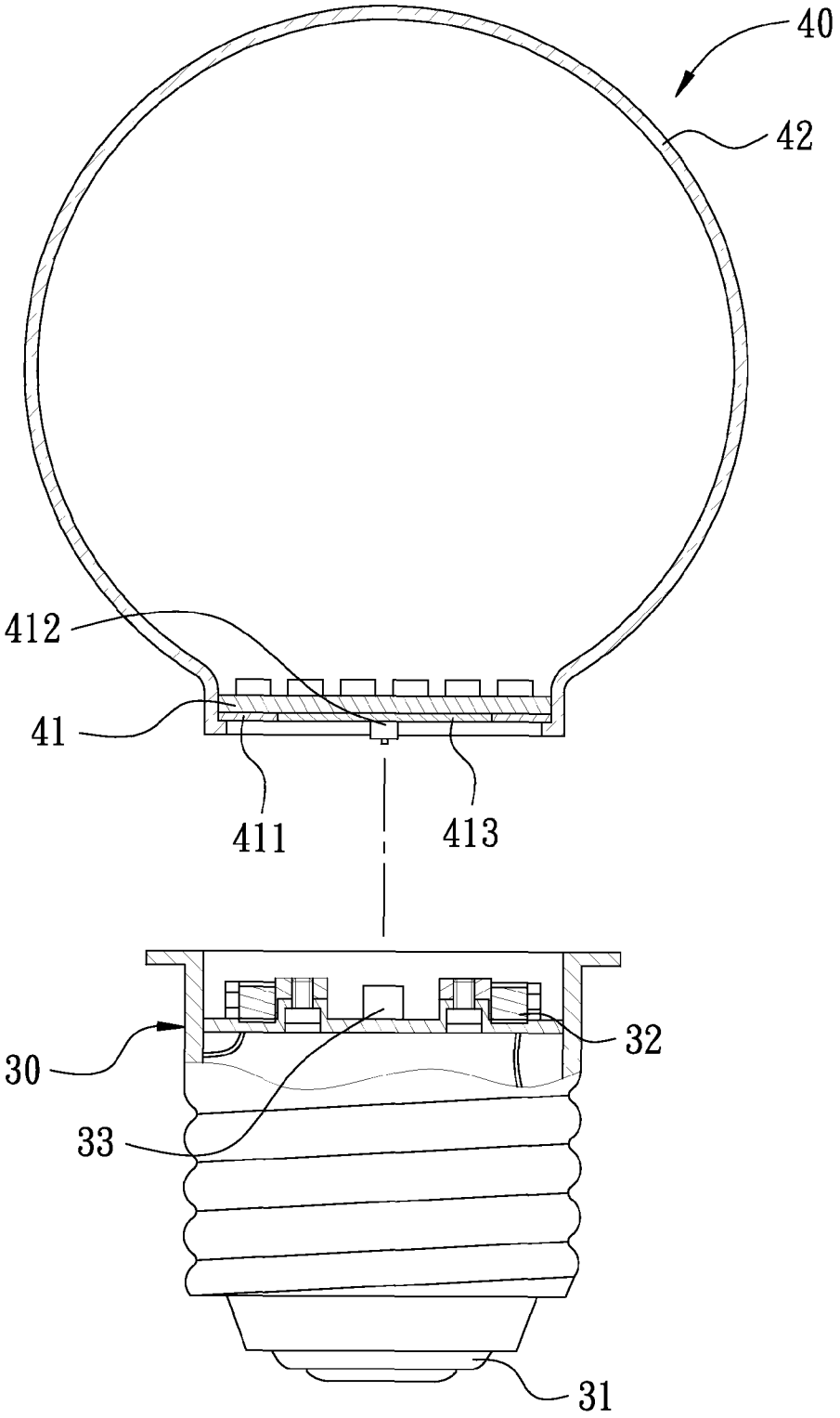
FIG. 7 is a cross-sectional view of a third preferred embodiment of a magnetic detachable multi-functional LED lamp in the present invention.

A third preferred embodiment of magnetic detachable multi-functional LED lamp in the present invention, as shown in FIG. 7, is an LED lamp bulb, which is equally formed with a power source lamp seat 30 and a luminous lamp unit 40. In this preferred embodiment, the power source lamp seat 30 is a metal lamp base containing a fundamental circuit and electronic elements of the LED lamp bulb in the interior. One end of the power source lamp seat 30 is provided with a section of threads 31 and another end is fixed with a plurality of magnetic units 32 and a connecting member 33. The luminous lamp unit 40 to be assembled on the power source lamp seat 30 is composed of an LED luminous module 41 and a lampshade 42. The LED luminous module 41 has its lower side provided with a third magnetic sucking member 411 and a combining member 412 respectively corresponding with the magnetic units 32 and the connecting portion 33 so that the LED luminous module 41 and the power source lamp seat 30 can be mutually attracted and combined to make electrical connection, and also has its lower side stuck with a heat-dissipating gluey pad 413. In this preferred embodiment, the combining member 412 is a metal terminal while the connecting portion 33 is a metal grooved seat corresponding with the combining member 412, and the lampshade 42 is integrally mounted around the circumferential edge of the LED luminous module 41. Thus, if the LED luminous module 41 is damaged, only the luminous lamp unit 40 has to be replaced with a new one, but the power source lamp seat 30 can still be used continuously.

Figure 8:
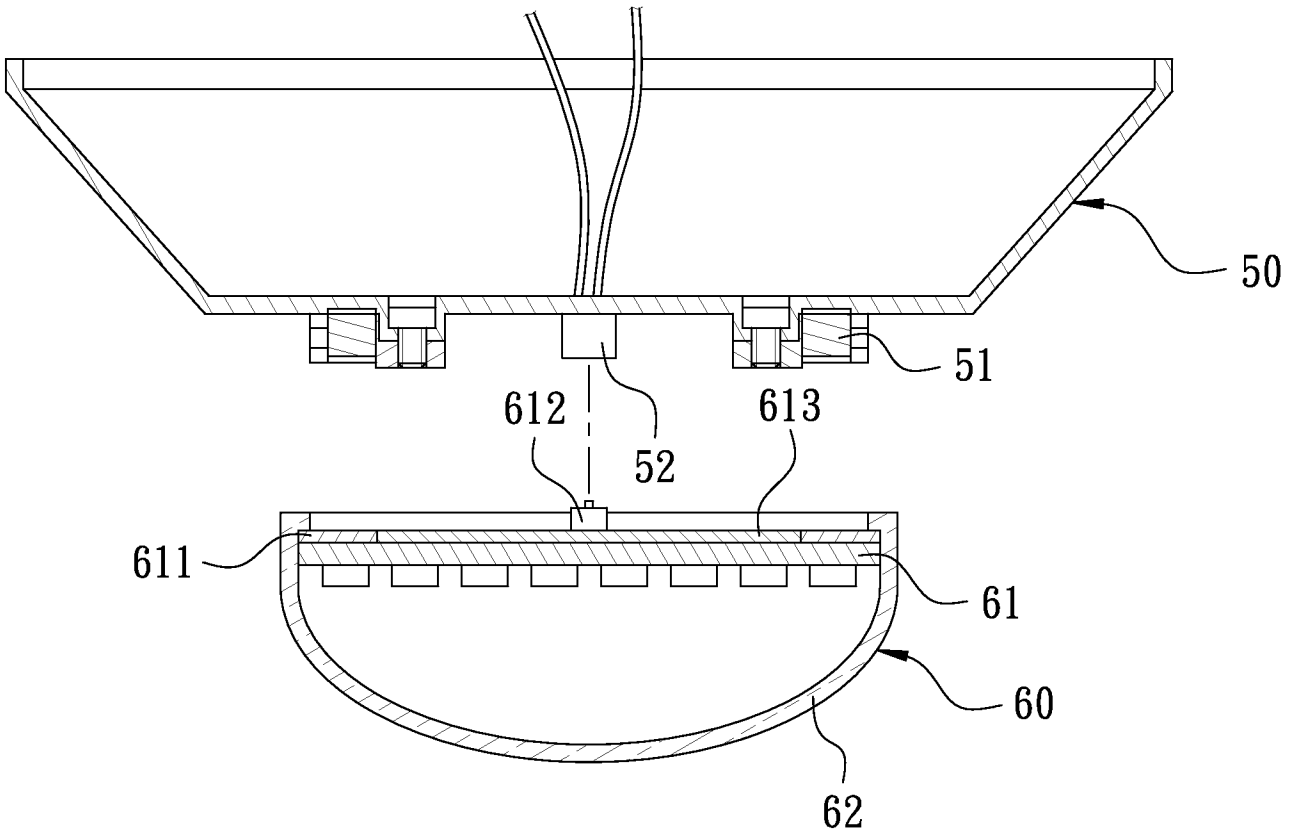
FIG. 8 is a cross-sectional view of a fourth preferred embodiment of a magnetic detachable multi-functional LED lamp in the present invention.

A fourth preferred embodiment of a magnetic detachable multi-functional LED lamp in the present invention, as shown in FIG. 8, is a dome-shaped LED lamp equally composed of a power source lamp seat 50 and a luminous lamp unit 60. The power source lamp seat 50 has one end secured with a plurality of magnetic units 51 and a connecting portion 52, while the luminous lamp unit 60 to be assembled on the power source lamp seat 50 consists of an LED luminous module 61 and lampshade 62. The LED luminous module 61 has its lower side provided with a fourth magnetic sucking member 611 and a combining member 612 respectively corresponding with the magnetic unit 51 and the connecting portion 52 so that the luminous lamp unit 60 and the power source lamp seat 50 can be mutually attracted and combined to make electrical connection, and the LED luminous module 61 further has its lower side stuck with a heat-dissipating gluey pad 613. In this preferred embodiment, the combining member 612 is a metal terminal while the connecting portion 52 is a metal grooved seat corresponding with the combining member 612. When the LED luminous module 61 is damaged, only the luminous lamp unit 60 has to be detached and replaced.

Figure 9:
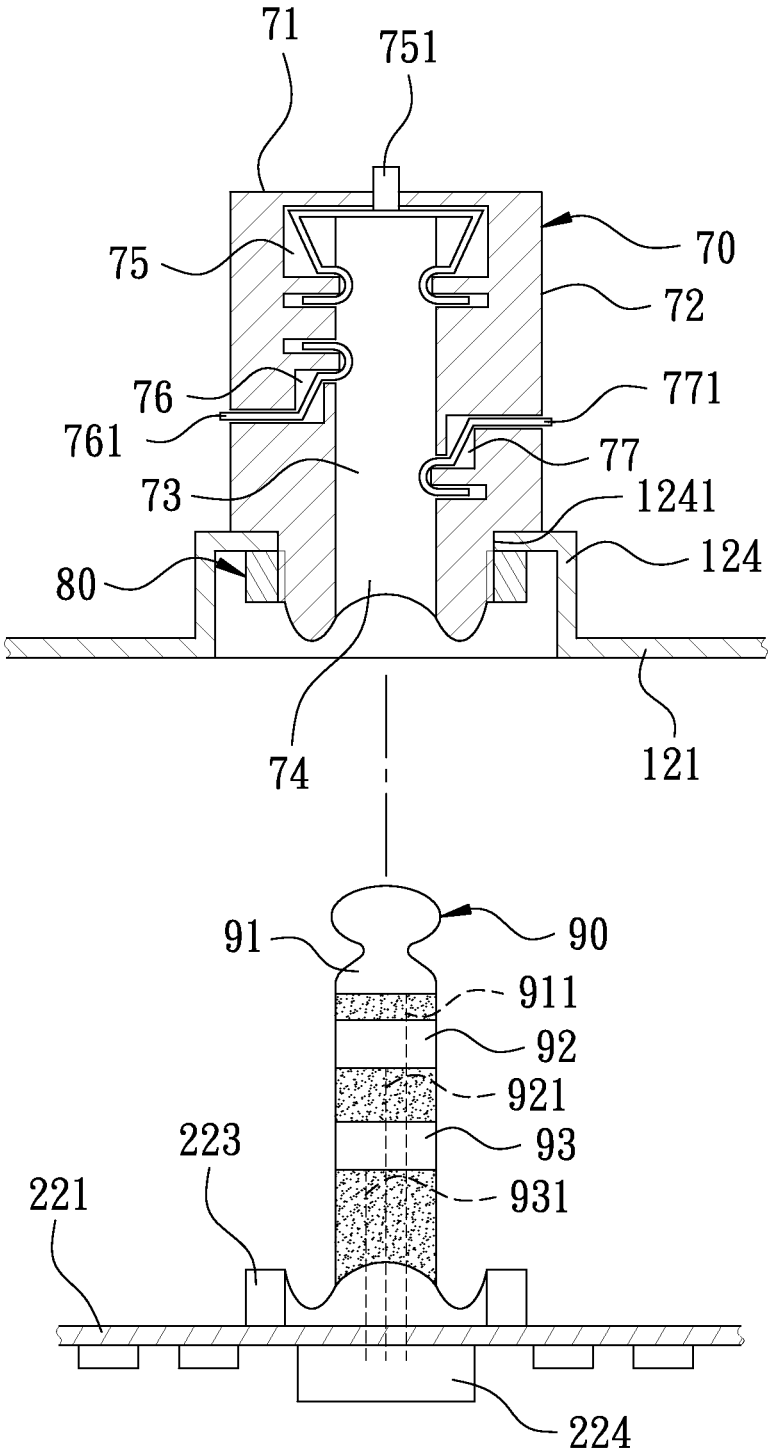
FIG. 9 is a partial cross-sectional view of another preferred embodiment of a central connecting portion and a combining member in the magnetic detachable multi-functional LED lamp of the first preferred embodiment in the present invention.

In additional, another preferred embodiment of the connecting portion 124 and the combining member 223 in the first preferred embodiment is further described below, referring to FIG. 9. The connecting portion 124 is provided with a receiving groove disposed in the bottom plate 121, and a bottom side bored with a through hole 1241. A seat body 70 is inserted through the through hole 1241 and assembled with the connecting portion 124 by means of a locking member 80. The seat body 70 is formed with a fundamental wall 71 and an annular wall 72 surrounding the circumferential edge of the fundamental wall 71, with an accommodating space 73 formed between the fundamental wall 71 and the annular wall 72. The seat body 70 has one end opposite to the fundamental wall 71 bored with an insert hole 74 communicating with the accommodating space 73, and the annular wall 72 of the seat body 70 has two opposite sides respectively provided with a first engage groove 75, a second engage groove 76 and a third engage groove 77. A first elastic electrode strip 751 is engaged with the first engage groove 75, having one end inserted out of the fundamental wall 71. A second elastic electrode strip 761 is engaged with the second engage groove 76, having one end inserted out of the annular wall 72, and a third elastic electrode strip 771 is engaged with the third engaged groove 77, having one end inserted out of the annular wall 72. Further, one end of the first, of the second and of the third elastic electrode strip 751, 761 and 771, which is respectively inserted out of the seat body 70, can be connected with a conducting wire (not shown) for making electrical connection with utility power. The combining member 223 is a bulgy block positioned on the base plate 221, having its central portion fixed with a conducting post 90 to be inserted through the insert hole 74 and received in the accommodating space 73. The conducting post 90 is formed with a neck comparatively small in diameter at a front section and provided thereon with a first electrode region 91, a second electrode region 92 and a third electrode region 93, which can be electrically connected with one another and which are respectively corresponding with the first, the second and the third elastic electrode strip 751, 761 and 771. The first, the second and the third electrode region 91, 92 and 93 are respectively provided with a first connecting pin 911, a second connecting pin 921 and a third connecting pin 931 that are electrically connected with the power control circuit unit 224. Since the seat body 70 and the conducting post 90 are non-directional in conduction, the connecting portion 124 and the combining member 223 can conveniently be butt jointed together. Furthermore, the neck at the front end of the conducting post 90 and the first elastic electrode strip 751 can be firmly engaged with each other, able to quickly position the conducting post 90 and prevent it from falling off. Additionally, both the lower edge of the seat body 70 and the upper edge of the combining member 223 are respectively formed into a wave shape and thus, when turned around, the combining member 223 can conveniently be disengaged from the seat body 70.

As can be understood from the above description, this invention has the following features and advantages.

1. The components of the power source and of the lamp of an LED lamp in the present invention can be combined and positioned mutually by means of magnetic units so they can easily be detached and replaced. Thus, when the components of the lamp that are easy to cause trouble are damaged, only the lamp has to be replaced, unnecessary to replace the power source that seldom causes fault. Therefore, it is needless to throw away or replace a whole set of the lamp, but only to replace or repair the damaged components, able to save money, greatly lessen the volume of electronic waste and achieve effects of environmental protection and energy saving.

2. The technique of magnetic detachable mode used in this invention can be applied to cylindrical lamps, disc lamps, stairway lamps and also to traditional threaded lamp bulbs, letting the magnetic detachable LED lamp of this invention regarded as a fluorescent lamp, which only need to replace a lamp bulb in case trouble occurs, thus tallying with a user's habit.

3. Both the lamp holder and the lampshade of this invention are designed to be detachable and replaceable; therefore, the lamp holder and the lampshade can be changed with proper color, shape and material in accordance with the requirements of interior decoration, achieving aesthetic effect for LED lamps.

4. The magnetic detachable LED lamp of this invention is provided with no locking holes or heat-dissipating holes, able to avoid light leakage and prevent mosquitoes and worms from getting into the LED lamp.

While the preferred embodiments of the invention have been described above, it will be recognized and understood that various modifications may be made therein and the appended claims are intended to cover all such modifications that may fall within the spirit and scope of the invention.

What is claimed is:

1. A magnetic detachable multi-functional LED lamp comprising:

a power source lamp seat provided thereon with a plurality of magnetic units;

a luminous lamp unit installed with a plurality of magnetic members respectively corresponding with said magnetic units of said power source lamp seat;

said luminous lamp unit detachably assembled on said power source lamp seat;

said power source lamp seat is composed of a lamp disc, a lamp holder and said magnetic units;

said lamp disc being made integrally of iron to be installed on a ceiling or on a top wall;

said lamp disc formed with an accommodating groove for receiving said lamp holder therein;

said lamp holder being made of aluminum that is easy to dissipate heat;

said lamp holder being formed with a bottom plate;

said bottom plate having a circumferential edge extended upward and formed with a circumferential wall;

said circumferential wall having upper end stretched outward and transversely to form an annular flange;

said annular flange extended downward and formed with a heat-dissipating portion;

said bottom plate of said lamp holder having a central portion provided with a connecting portion;

said bottom plate having a circumferential edge formed with an annular recessed edge;

said lamp holder disposed with a plurality of receiving members; and said magnetic units respectively received in said receiving members.

2. A magnetic detachable multi-functional LED lamp as claimed in claim 1, wherein said lamp holder has an annular recess facing said bottom plate between said annular flange and said circumferential wall.

3. A magnetic detachable multi-functional LED lamp as claimed in claim 1, wherein said receiving members are positioned in chambers defined by said annular recess and said bottom plate, and each said chamber has a bottom side bored with a first threaded hole.

4. A magnetic detachable multi-functional LED lamp as claimed in claim 1, wherein each said magnetic unit contains a powerful magnet, a protective casing and a bolt, said protective casing bored with a second threaded hole corresponding with said first threaded hole.

5. A magnetic detachable multi-functional LED lamp easy as claimed in claim 1, wherein said luminous lamp unit is composed of a lampshade and an LED luminous module, said lampshade set thereon with a first magnetic sucking member corresponding with said magnetic unit on said annular flange, said LED luminous module provided with a base plate, said base plate having an upper side and a lower side, said base plate having said upper side installed thereon with a plurality of LEDs, said base plate having said lower side provided with a second magnetic sucking member and a combining member respectively corresponding with said magnetic unit and said connecting portion of said bottom plate.

6. A magnetic detachable multi-functional LED lamp as claimed in claim 5, wherein said LED luminous module is disposed with a built-in power control circuit unit.

7. A magnetic detachable multi-functional LED lamp as claimed in claim 5, wherein said first magnetic sucking member is an iron ring covered around circumferential edge of said lampshade.

8. A magnetic detachable multi-functional LED lamp as claimed in claim 5, wherein said second magnetic sucking member is an iron ring stuck on said base plate.

9. A magnetic detachable multi-functional LED lamp as claimed in claim 5, wherein said luminous lamp unit is provided with a lamp cover assembled on said LED luminous module.

* * * * *